United States Patent [19]

Johansson

[11] 4,058,077

[45] Nov. 15, 1977

[54] POWER BOATS WITH HYDRODYNAMIC LIFTING DEVICES

[76] Inventor: Sten E. Johansson, 5711 S. 152nd Place, Seattle, Wash. 98188

[21] Appl. No.: 721,057

[22] Filed: Sept. 7, 1976

Related U.S. Application Data

[63] Continuation-in-part of Ser. No. 535,719, Dec. 23, 1974, Pat. No. 3,980,035.

[51] Int. Cl.[2] ..... B63B 1/30

[52] U.S. Cl. ..... 114/283

[58] Field of Search ..... 114/66.5 R, 66.5 H, 114/66.5 P, 66.5 S, 122, 126, 271–282, 291

[56] References Cited

U.S. PATENT DOCUMENTS

| | | | |
|---|---|---|---|
| 2,984,197 | 5/1961 | Bader | 114/66.5 H |
| 3,026,839 | 3/1962 | Fridge | 114/66.5 P |
| 3,288,096 | 11/1966 | Swenson | 114/66.5 S |
| 3,707,936 | 1/1973 | Harris | 114/66.5 P |

FOREIGN PATENT DOCUMENTS

| | | | |
|---|---|---|---|
| 1,436,025 | 11/1966 | France | 114/66.5 H |
| 575,883 | 5/1933 | Germany | 114/66.5 H |

*Primary Examiner*—Trygve M. Blix
*Assistant Examiner*—Jesus D. Sotelo
*Attorney, Agent, or Firm*—Graybeal, Barnard & Uhlir

[57] ABSTRACT

A pair of lifting planes are secured to the hull of a boat on opposite sides of the keel. The lifting planes intersect the bottom surfaces of the hull at lines oriented generally along side the keel. The lifting planes have swept back leading edges and a span generally reaching to the chines. The outboard portions of said lifting planes are located at or adjacent to the longitudinal location of the center of gravity of the boat. The longitudinal location of the lifting planes is such that the resulting lifting force generated by the lifting planes at planing speeds acts adjacent to the center of gravity of the boat.

10 Claims, 10 Drawing Figures

12
14
20
28
26
22
24
18
16
48
44
CG
30
74
36
40
a
10

24
18
44
46
CG
74
76
30
36
38
32
3
3
40
78
80
b
34
10

48
30
12
32
24
18
d
10
48
c 40
10
30
36
38
32
42

POWER BOATS WITH HYDRODYNAMIC LIFTING DEVICES

CROSS REFERENCE TO RELATED APPLICATION

This is a continuation-in-part of my copending application Ser. No. 535,719, filed Dec. 23, 1974, and entitled ATTITUDE CONTROL DEVICES FOR STERN DRIVE POWER BOATS now U.S. Pat. No. 3,980,035, granted Sept. 14, 1976.

BACKGROUND OF THE INVENTION

1. Field of the Invention

This invention relates in general to the hull construction of a power boat, and in particular to a V- or deep V-hull, which combines the smooth ride of a V-hull and its inherent high drag level with a variable hull bottom providing a relatively smooth ride but with a low drag level.

2. Description of the Prior Art

It is known to equip power boats with planing or lifting members, for decreasing the drag on the boat during high speed travel. The major drag portion for planing hulls is usually caused by friction. The primary object of my invention is therefore to reduce the wetted area of said hulls. Examples of patented planing or lifting member arrangements are shown in U.S. Pat. No. 2,967,503, granted Jan. 10, 1961 to Kenneth N. Unger; U.S. Pat. No. 3,026,839, granted Mar. 27, 1962, to Clifford V. Fridge; U.S. Pat. No. 3,213,818, granted Oct. 27, 1965, to Richard L. Barkly; U.S. Pat. No. 3,288,096, granted Nov. 29, 1966, to Armand D. Swensson; U.S. Pat. No. 3,380,421, granted Apr. 30, 1968, to Josef F. Lstiburek and U.S. Pat. No. 3,707,936, granted Jan. 2, 1973, to Henry B. Harris. These patents disclose planing or lifting plane arrangements that differ in both design and function from the present invention.

SUMMARY OF THE INVENTION

According to an aspect of the invention, a power boat is provided with a pair of lifting planes positioned on opposite sides of the keel of the power boat. These lifting planes both (1) lift the boat and (2) substantially prevent water attachment to the deadrise in order to reduce the wetted area of the hull. The lifting planes have upper and lower surfaces and inboard edges which intersect the bottom surfaces of the boat at lines oriented generally alongside the keel.

The lifting planes have a span generally reaching to the chines of the boat. The outboard portions of said lifting planes are located generally at or adjacent to the longitudinal location of the center of gravity of the boat. The lifting planes have leading edges which extend from said outboard portions forwardly and inboard towards the keel, forming a sweep back of said leading edges and a forward pointed portion of said lifting planes which provide the basis for smooth wave penetration.

The longitudinal location of the lifting planes is such that the resulting lifting force on said lifting planes at planing speeds acts adjacent to the center of gravity of the boat in order to provide the basis for minimum wetted area and minimum force required for trim.

According to another aspect of the invention, the wetted areas of said lifting planes decrease with increasing planing speed in calm water so that the main portion of the lift is created by the aft portions of said lifting planes while the resulting lift force still acts adjacent to the center of gravity of the boat. This feature makes it possible to considerably reduce the wetted area of the hull. A feature that can not be accomplished by conventional V-hulls or proposed designs in referenced patents.

According to still another aspect of the invention, the lifting planes may have cambered aft portions with lower surfaces configured to deflect the water downwardly. This improves the lift capability of said lifting planes and reduces the wetted area of the hull further.

According to another aspect of the invention, the power boat may include vertical trim control means at the rear of said hull which are used in conjunction with the planing members.

According to still another aspect of the invention, the lifting planes may be located such that the resulting lifting force acts forwardly of the center of gravity of the boat. Part of the weight of the boat is then carried by said trim control means reducing the weight on the lifting planes in order to reduce the wetted area still further.

According to an aspect of the invention, the inboard edges of the lifting planes may intersect the bottom surfaces of the hull along lines on opposite sides of the keel which both diverge apart and rise as they extend forwardly.

According to another aspect of the invention, the hull may include a bottom recess for receiving the lifting planes. The lifting planes may be movable about their inboard edges from a position within said hull recesses to a position downwardly where the dihedral of the planes approaches zero degrees. The leading edges of the lifting planes may be swept back so that when the lifting planes are retracted such edges are generally parallel with the forward contact line of the hull and water at incipient planing on calm water.

According to an aspect of the invention, the leading edges of the planing members are positioned to lead the forward boundaries of the water spray from the keel during planing, throughout their full extent, so as to prevent water attachment to the bottom surface of the hull both above and substantially aft of the lifting planes.

According to another aspect of the invention, the power boat comprises support means interconnected between outboard portions of the power boat and outer portions of the lifting planes. The support means may be compressible for the purpose of reducing water impact forces acting on the lifting planes. Also, the support means may be adjustable for the purpose of adjusting the angular position of the lifting planes relative to the bottom surfaces.

BRIEF DESCRIPTION OF THE DRAWING

In the drawing, like reference numerals denote corresponding parts throughout the several views, and.

DESCRIPTION OF THE PREFERRED EMBODIMENTS

Figures 1, 2, 3, 4:
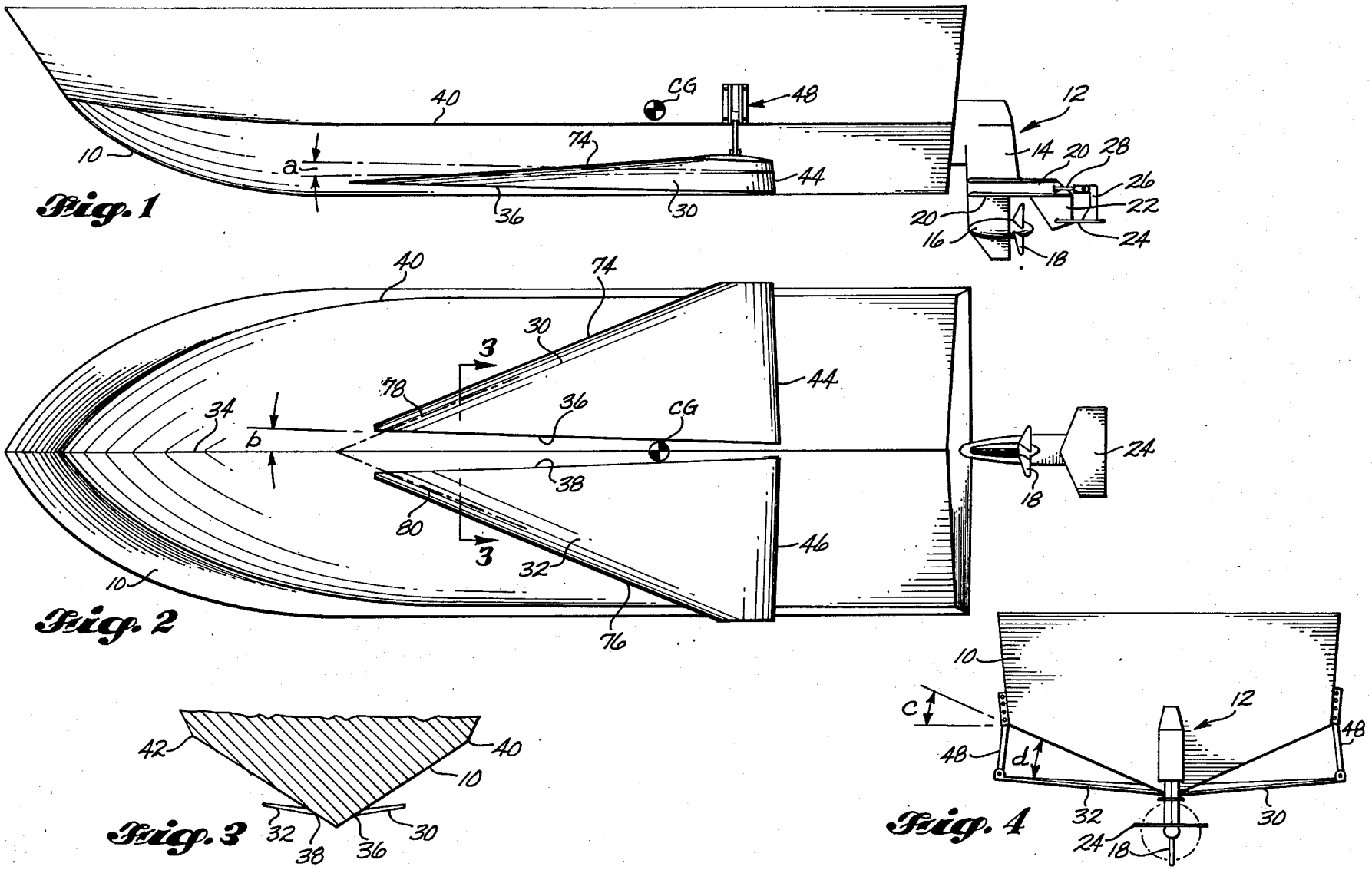
FIG. 1 is a side elevational view of a power boat that is equipped with lifting or planing members in accordance with the present invention, powered by a stern drive assembly equipped with a trim vane.
FIG. 2 is a bottom plan view of the power boat of FIG. 1.
FIG. 3 is a cross-sectional view taken substantially along line 3—3 of FIG. 2.
FIG. 4 is a rear elevational view of the power boat shown by FIGS. 1–3.

The power boat 10 shown by FIGS. 1–4 includes a stern drive assembly 12 which may be conventional except for the trimming mechanism which is the inventive subject matter of my aforementioned parent application Ser. No. 535,719.

The stern drive assembly includes a drive shaft housing 14 having a gear box 16 at its lower end. The gear box 16 rotatably supports a propeller shaft onto which a propeller 18 is mounted. In accordance with conventional design, the housing 14 includes a cavitation plate 20 positioned over the propeller 18. Housing 14 includes a rearwardly projecting horizontal portion 21 from which a vertical strut 22 depends. A trim vane 24 is mounted on and by the strut 22 for movement about a horizontal axis extending transversely to the center line axis of the boat 10. Vane 24 may include an upstanding control arm 26 which is attached at its upper end to a control cable 28. A rearward movement of control cable 28 and the upper end of arm 26 will cause an increase in the angle of attack of the lower surface of vane 24. A forward movement of cable 28 and the upper end of arm 26 will cause a decrease in such angle of attack. As explained in my aforementioned application Ser. No. 535,719, the trim vane 24 is preferably located within the slipstream of the propeller 18, as illustrated. This is an advantageous relationship because the effectiveness of the trim vane 24 is usually higher in the slipstream than in the ambient water flow. Also, the position of the trim vane 24 behind the propeller 18 provides a long moment arm between it and the center of pitch of the boat 10. These two factors make it possible to construct the trim vane 24 relatively small in size.

Figure 6:
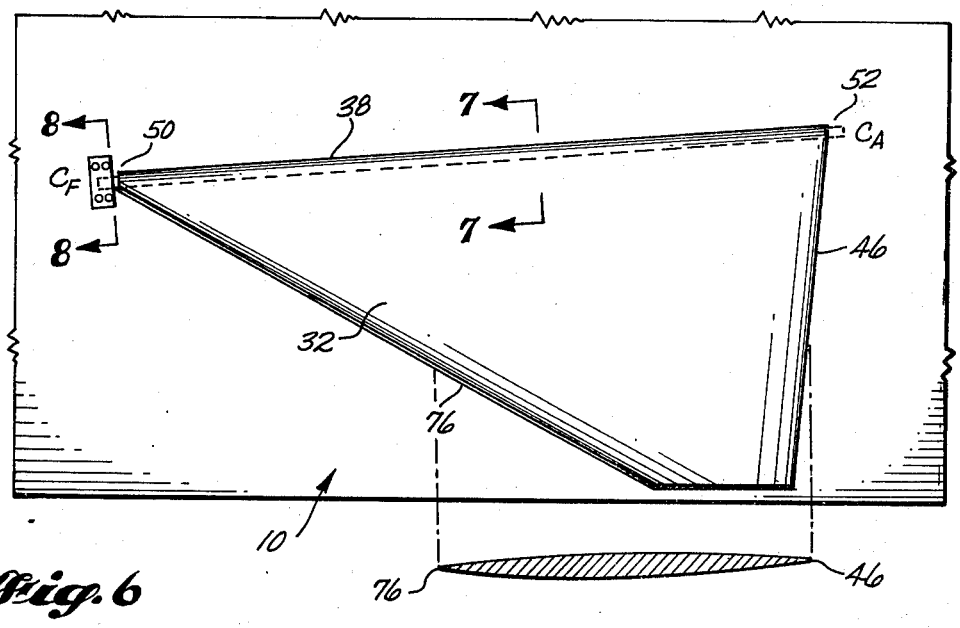
FIG. 6 is an enlarged scale bottom plan view of one lifting member and the surrounding bottom portion of the boat hull.

According to the present invention, the power boat 10 includes a pair of relatively small area lifting planes 30, 32, positioned on opposite sides of the boat's stem-keel 34. The lifting planes 30, 32 have upper and lower surfaces and preferably a streamlined sectional shape (FIG. 6). The lifting planes further include inboard edges 36, 38 which intersect the bottom surfaces of the boat hull 10 at lines spaced both above and generally alongside the stem-keel line 34, in such a manner that a portion of the boat hull depends below the lower surfaces of the lifting planes 30, 32, between the lifting planes 30, 32 (FIGS. 1–3, for example).

The lifting planes 30, 32 have a span generally reaching to the chines 40, 42. The outboard portions of said lifting planes are located at or adjacent to the longitudinal location of the center of gravity CG of the boat 10. In the embodiment illustrated by FIGS. 1–3, the outboard ends of the lifting planes 30, 32 are located slightly rearwardly of the center of gravity CG.

Lifting planes 30, 32 further include leading edges 74, 76 which extend from said outboard portions forwardly and inboard towards the keel, joining said inboard edges 36, 38. Said leading edges provide a basis for smooth wave penetration when the waves are approached normally, reducing the water impact forces and preventing water attachment to the deadrise.

As best shown by FIGS. 1 and 2, the longitudinal location of the lifting planes 30, 32 is such that the resulting lifting force on said lifting planes 30, 32 at planing speeds acts adjacent to the center of gravity of the boat. As a result, the force required to trim the boat will be relatively small and the wetted area of the boat is considerably reduced.

As shown by FIGS. 1 and 2, the inboard edges 36, 38 of the lifting planes 30, 32 may intersect the bottom surfaces of the hull 10 above the keel 34 along lines on opposite sides of the keel which both diverge apart and rise as they extend forwardly.

Referring to FIGS. 1–4 in particular, the incidence angle $a$ of the lifting planes 30, 32 represents the angle of attack that said lifting planes 30, 32 receives in addition to the angle of attack, defined in a vertical plane, of the deadrise. The incidence angle $a$ can be defined by the angle $b$ between the inner edge or hingeline 36, 38 and the center line of the boat *in the plane of the deadrise,* in combination with the angle $c$ representing the slope of the deadrise at the location of the lifting planes 30, 32, and the deflection angle $d$ of the lifting planes 30, 32. The relationship between the angles $a$, $b$, $c$ and $d$ can be written $$\tan a = (\sin b \cdot \tan d)/(\cos c + \sin c \cdot \cos b \cdot \tan d)$$

The direction of the inner edges or hingelines 36, 38 defined by the angles $b$ and $c$ constitutes the rate of increase in incidence angle $a$ as the lifting planes 30, 32 are deflected downwardly. If the angle $b$ is 0°, the hinge lines 36, 38 are parallel to the center line of the boat and hence the incidence angle $a$ is zero regardless of deflection. If the angle $b$ is 90°, the hingelines 36, 38 are normal to the center line of the boat and, for small deflection angles, the incidence angle $a$ is equal to the deflection angle $b$ divided by $\cos c$, but the lifting planes 30, 32 cannot form the substantially flat plan form that is essential for hydroplaning and low drag. According to the present invention, the lifting members 30, 32 provide both the desired angle of incidence and plan form necessary for hydroplaning with low drag as well as dihedral for adequate roll stability.

The lifting planes 30, 32 may include end supports 48 interconnected between their outer portions and opposite side portions of the boat hull 10 in the vicinity of the chines 40, 42. The support struts 48 may be merely in the nature of shock absorbers, i.e., compressible for the purpose of reducing water impact forces acting on the lifting planes 30, 32, or may be fixed or adjustable length members.

Preferably, the planing members 30, 32 are mounted for pivotal movement about the inner edge lines 36, 38 and the support struts 48 are adjustable in length for the purpose of adjusting the angular position with the lifting members 30, 32 relative to the bottom of the boat 10.

Figure 7:
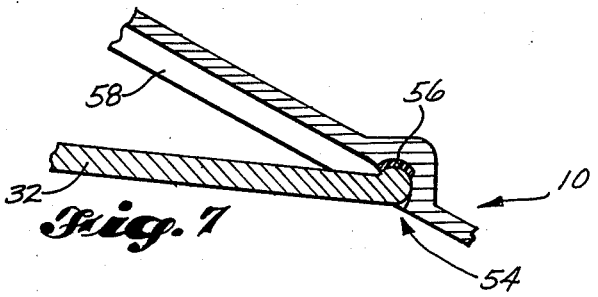
FIG. 7 is a sectional view taken substantially along line 7—7 of FIG. 6, showing a manner of mounting and supporting the inner edge of the planing member where it intersects the bottom of the boat hull.
Figure 8:
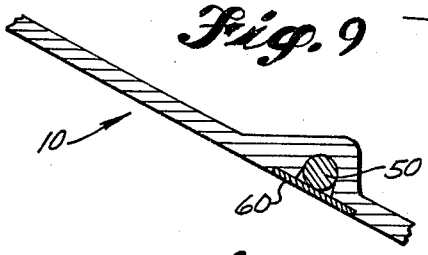
FIG. 8 is a sectional view taken substantially along line 8—8 of FIG. 6, showing the detail of a forward end hinge structure and surrounding bottom construction of the hull.

By way of typical and therefore non-limitative example, FIGS. 6–8 show the lifting planes 30, 32 connected to the boat's bottom by means of pintle and socket hinges at the front and rear ends of the inner edges 36, 38. As shown by FIG. 7, the inner edge portions 36, 38 may have cylindrical curvature and be adapted to fit within a complementary shaped recess 54 formed in the bottom of the boat lengthwise of each inner edge 36, 38. The recess 54 may be at least partially lined with a support strip of Teflon (trademark) or the like. Also, the bottom may be recessed in the vicinity of the lifting planes 30, 32, so that when the lifting planes are retracted they will be within the recesses (e.g. recess 58 in FIG. 7) and the lower surface thereof is substantially even or flush with the bottom surface of the boat 10.

As shown by FIGS. 6 and 8, the pintle at the rear end hinge location 52 may be received within a socket formed within the bottom material of the boat. The pintle at the forward end may be received within a removable socket 60 which may be secured to the boat bottom by means of screws or the like (FIG. 8). Preferably, each support strut 48 includes a bracket 62 (FIG. 5) which is connectible to a side portion of the boat hull 10. Each bracket 62 includes a pair of spaced apart flanges 64, 66 which project outwardly substantially normal to the side surface of the boat hull 10.

Figure 5:
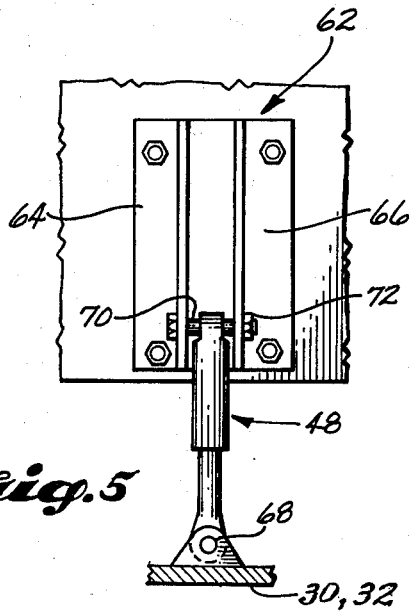
FIG. 5 is an enlarged scale fragmentary view of the adjustable support strut region of FIG. 1.

A strut 48 is connected at its lower end 68 to a lifting member 30, 32. The flanges 64, 66 are formed to include a plurality of vertically spaced apart pairs of horizontally aligned openings. The angular position of each lifting plane 30, 32 is determined by aligning an eye at the upper end of the support strut 48 therefor with a pair of the aligned openings, then inserting a cross bolt 70 through all three openings, and then securing bolt 70 in place by a nut 72. In FIG. 5 the strut 48 is shown to be in the nature of a shock absorber, i.e. it is compressible when loaded.

Referring now to FIG. 2, the leading edges 74, 76 of the lifting planes 30, 32 are swept back such that said edges 74, 76 are generally in parallelism with the forward contact lines 78, 80 of the boat hull and the water at incipient planing on calm water. As also shown by FIG. 2, these leading edges 74, 76 are positioned to lead the forward boundary 78, 80 of the water spray from the keel during planing, throughout their full extent, so as to prevent water attachment to the bottom surface of the hull both above and substantially aft of the lifting planes 30, 32.

As earlier mentioned, the hull bottom may be recessed at 58 to receive the lifting planes 30, 32, so that when such lifting planes 30, 32 are fully retracted, their lower surfaces form a continuation of the bottom surface of the boat hull which extends around the lifting plane recess 58. Also, the lifting planes 30, 32 may have longitudinal grooves or fences for the purpose of reducing spray or sideslip.

When it is not desired to use the lifting planes 30, 32, the struts 48 are adjusted upwardly so as to bring the lifting planes 30, 32 generally flat up against the bottom of the boat (or within the recess in the case of the boat hull having recesses). When it is desired to plane the boat the struts 48 are adjusted downwardly to place the lifting planes 30, 32 into a desired angular position relative to the boat bottom.

During high speed operation of the boat the water traveling relative past the lifting planes 30, 32 tends to exert a vertical force on the lifting planes 30, 32, to, in that manner, raise the boat vertically until it is planing on the bottom surfaces of the planes 30, 32.

Owing to the positive angle of attack of the lifting planes 30, 32, and the forward extension of the leading edges good separation occurs between the water and the deadrise. Since the main lifting portions of the planes 30, 32 are placed generally vertically below the center of gravity CG of boat 10, the boat is lifted generally straight vertically upwardly, requiring a minimum trim force.

Figure 9:
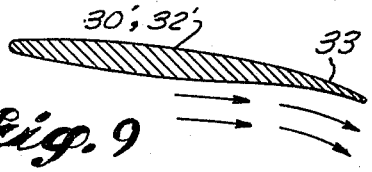
FIG. 9 is an enlarged scale elevational view of an after portion of a modified form of lifting plane, characterized by an aft portion with lower surfaces configured to deflect the water flow downwardly.
Figure 10:
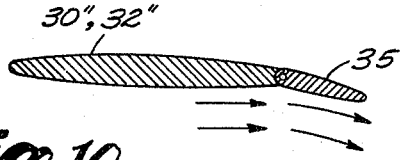
FIG. 10 is a view like FIG. 9, but of another modified form of lifting plane, characterized by movable aft portions which are operable for deflecting the water flow downwardly.

The vertical attitude or trim of the boat is controlled by the trimming apparatus at the rear end of the boat. Preferably, but necessarily, the trimming apparatus is of the type discussed above and in connection with my copending application Ser. No. 535,719. The lifting planes 30', 32' may have cambered aft portions 33 with lower surfaces configured to deflect the water flow downwardly, as shown by FIG. 9. Or, the lifting planes 30'', 32'' may have movable aft portions 35 for the purpose of deflecting the water flow downwardly, as shown by FIG. 10.

A full size prototype was tested on a seventeen foot stern-drive power boat. The planform of the planing members closely corresponded to the planform shown by FIG. 2. The test took place in rather calm water. Following an initial adjustment of the longitudinal positioning of the lifting planes, it was found that the boat started to plane on the lifting planes at about fifteen miles per hour. Then, the boat accelerated very rapidly under good roll and pitch stability. The tests that were conducted indicated that the concept is very feasible and the drag reduction is good.

Tests were also conducted with respect to a scale model of a power boat. The model measured 24 inches in length and weighed about 3½ pounds. The model was towed alongside a full size power boat. When the model reached a speed corresponding to about 10–12 knots of a full size boat, flow separation started at the stern. When the speed was increased to about 14–15 knots, the drag increased to a relatively high level. Planing began at about 16–18 knots and a considerable reduction in drag was experienced. At about 25 knots, planing was fully developed and desired flow pattern was achieved. When the model was towed through relatively rough water, the roll and pitch stability was very good. The boat rode rather smoothly for two reasons. Firstly, the swept leading edge of the lifting planes 30, 32 allowed smooth wave penetration. Secondly, the loading on the members 30, 32 was rather high, making them rather insensitive to changes of angle of attack caused by the waves.

The lifting planes 30, 32 were removed and the scale model was towed without them to a speed corresponding to about 30–35 knots of a full size boat. The stern rode rather deeply in the water and the spray pattern showed much more turbulence than was experienced when the boat was planing up on the lifting planes 30, 32.

The model was also equipped with a remote control so that the lifting planes 30, 32 could be extended and retracted independently of each other during travel and a trimming vane at the stern could also be operated at the same time.

It was found amongst other things that for best performance the lifting planes 30, 32 should not be extended before the boat has reached the initial planing condition in order to avoid the drag rise before the planing of the lifting members. Thus, it is preferable that the support struts 48 be of a type permitting the lifting planes 30, 32 to be extended and retracted during travel.

The model tests indicated that the lifting plane arrangement of this invention possesses good stability about the roll axis. Due to the forward extending leading edges of the lifting planes, the spray from the keel was deflected by the lifting planes and did not attach itself to the deadrise above or aft of the lifting members, except for a narrow strip along the keel to the transom. This portion of the water flow is intended to provide adequate supply of water to the propulsion unit. Only a small amount of spray was developed from the lower surfaces of the lifting planes at planing speeds. The drag measurements showed that the drag of the model boat when planing on the lifting planes was about 50% less than when planing on its original V-hull.

What is claimed is:

1. A power boat comprising a V-bottom hull having a stern, a keel, a pair of topsides and a pair of bottom surfaces which rise laterally from said keel to where the bottom surfaces join the topsides; and lifting plane means adapted to improve the lifting capability of the forward wetted area of the hull and to substantially eliminate the aft wetted area during planing, said lifting plane means comprising:

a pair of lifting planes secured to said hull on opposite sides of said keel;

said lifting planes having inboard edges which are connected to the bottom surfaces of the hull at lines oriented generally alongside the keel, and having upper and lower surfaces which during planing extend at acute angles relative to the bottom surfaces, said lifting planes having a span substantially reaching to where the bottom surfaces join the topsides;

said lifting planes having trailing edges which are spaced well forwardly of said stern, so that a substantial amount of bottom surface area exists rearwardly of said trailing edges;

said lifting planes having leading edges which are swept back such that said edges generally are oriented in parallel with the forward contact lines of said V-bottom hull and water at incipient planing on calm water, and said leading edges being positioned to lead the forward boundaries of the water spray from the keel during planing, throughout their full extent, so as to prevent water attachment to the bottom surfaces of the hull both above and substantially aft of said lifting planes; and said lifting planes having a longitudinal location relative to the hull such that the resulting lifting force of said lifting planes at planing speeds acts adjacent to the center of gravity of the boat.

2. A power boat according to claim 1, wherein the inboard edges of said lifting planes are attached to the bottom surfaces along lines on opposite sides of the keel which both diverge apart and rise as they extend forwardly.

3. A power boat according to claim 1, wherein said lifting planes are movable about their inboard edges from a position generally against the hull to a position downwardly where the dihedral of the lifting planes approaches 0°.

4. A power boat according to claim 3, wherein the hull includes a bottom recess for said lifting planes and said lifting planes are movable about their inboard edges from a position within said recess in the hull to said position downwardly where the dihedral of the lifting planes approaches 0°.

5. A power boat according to claim 3, wherein the inboard edges of the lifting planes are attached to the bottom surfaces along lines on opposite sides of the keel which both diverge apart and rise as they extend forwardly.

6. A power boat according to claim 1, comprising support means interconnected between the hull and the lifting planes, said support means being adapted for absorbing shock for the purpose of reducing water impact forces acting on the lifting planes.

7. A power boat according to claim 6, wherein said support means are adjustable for the purpose of adjusting the angular position of the lifting planes relative to the bottom surfaces.

8. A power boat according to claim 1, wherein said lifting planes have cambered aft portions with lower surfaces configured to deflect the water flow downwardly.

9. A power boat according to claim 1, wherein said lifting planes have movable aft portions for the purpose of deflecting the water flow downwardly.

10. A power boat according to claim 1, further comprising vertical trim vane means at the stern, for producing a vertically directed force on said power boat generally at the stern.

* * * * *